US007766179B2

(12) United States Patent
George et al.

(10) Patent No.: US 7,766,179 B2
(45) Date of Patent: Aug. 3, 2010

(54) PORTABLE CONTAINER AND TABLE ASSEMBLY

(76) Inventors: David M. George, 277 Woodland Dr., Brightwaters, NY (US) 11718; Scott P. Woodrick, 54 Wingam Dr., Islip, NY (US) 11751

( * ) Notice: Subject to any disclaimer, the term of this patent is extended or adjusted under 35 U.S.C. 154(b) by 304 days.

(21) Appl. No.: 12/104,212

(22) Filed: Apr. 16, 2008

(65) Prior Publication Data

US 2009/0260546 A1 Oct. 22, 2009

(51) Int. Cl.
*B65D 88/00* (2006.01)
*B65D 90/12* (2006.01)
*B65D 69/00* (2006.01)

(52) U.S. Cl. ..... 220/1.5; 220/629; 206/223; 280/30

(58) Field of Classification Search ..... 220/1.5, 220/629; 280/30; 206/223, 549; 190/11, 190/12 A See application file for complete search history.

(56) References Cited

U.S. PATENT DOCUMENTS 2,603,500 A * 7/1952 Messier ..... 280/30
3,873,114 A * 3/1975 Brown ..... 280/30
5,419,455 A * 5/1995 Russeau ..... 220/575
5,431,298 A * 7/1995 Ahn et al. ..... 220/756
5,551,558 A 9/1996 Bureau
6,328,179 B1 12/2001 Conrado et al.
2006/0065665 A1 3/2006 Swartfager et al.

* cited by examiner

*Primary Examiner*—Harry A Grosso
(74) *Attorney, Agent, or Firm*—Law Offices of Michael L. Wise, LLC

(57) ABSTRACT

An assembly comprises a container having a base, one or more sidewalls extending upward from the base to a frame-shaped member that forms an upper rim, and one or more access hatches supported by the frame-shaped member and forming a lid. One or more table leaves are attached to the frame-shaped member, each of the one or more table leaves operative to rotate into a respective closed position and into a respective open position. Each of the one or more table leaves is disposed above at least a portion of the container when in its closed position, and each of the one or more table leaves is at least partially disposed above a region to a side of the container when in its open position.

19 Claims, 8 Drawing Sheets

PORTABLE CONTAINER AND TABLE ASSEMBLY

FIELD OF THE INVENTION

The present invention relates generally to a portable container and table assembly, and, more particularly, to a portable assembly adapted for transporting and serving food and beverages.

BACKGROUND OF THE INVENTION

It is frequently desirable to serve food and beverages while participating in outdoor activities such as camping, picnicking, and boating in order to both provide sustenance and enhance the enjoyment of those participating in the activity. As a result, compact, portable containers capable of transporting food, beverages, and their associated implements (e.g., glasses, plates, and utensils) are becoming increasingly popular.

While there are several portable container designs capable of transporting food and beverages, few of these designs make accommodations for conveniently serving the food and beverages once an outdoor location is reached. One means of addressing this problem is to fit the portable container with one or more folding table leaves, thereby allowing the container to serve the dual purpose of container and serving table. Designs relevant to implementing such folding table leaves may be found in, for example, U.S. Pat. Nos. 5,551,558 to Bureau and U.S. Pat. No. 6,328,179 to Conrado et al., as well as U.S. Patent Application Publication No. 2006/0065665 to Swartfager et al., none of which are admitted as prior art by their mention in this Background Section. Nevertheless, many such container and table combinations are poorly suited for use in the rough environmental conditions that may be associated with some outdoor activities. While picnicking or camping, for example, it may be necessary to serve food and beverages while located on uneven and unstable terrain such as a beach or hillside. While boating, it may be necessary to serve the contents of the container while the boat is pitching and rocking, sometimes quite vigorously.

For the foregoing reasons, there is a need for designs for portable container and table combinations that are well suited for transporting and serving food and beverages during the rigors of outdoor activities.

SUMMARY OF THE INVENTION

Embodiments of the present invention address the above-identified need by providing a portable container and table combination well suited for use when pursuing outdoor activities.

In accordance with an aspect of the invention, an assembly comprises a container having a base, one or more sidewalls extending upward from the base to a frame-shaped member that forms an upper rim, and one or more access hatches supported by the frame-shaped member and forming a lid. One or more table leaves are attached to the frame-shaped member, each of the one or more table leaves operative to rotate into a respective closed position and into a respective open position. Each of the one or more table leaves is disposed above at least a portion of the container when in its closed position, and each of the one or more table leaves is at least partially disposed above a region to a side of the container when in its open position.

In accordance with another aspect of the invention, the assembly further comprises a stabilizing bar attached to an underside of the base of the container. The stabilizing bar is operative to rotate into a first position and into a second position. At least a portion of the stabilizing bar projects from under the base when in the first position. The entirety of the stabilizing bar underlies the base when in the second position.

In accordance with one of the above-identified embodiments of the invention, an assembly comprises a container having a base and four sidewalls that extend upward from the base to a frame-shaped member that form an upper rim. In addition, two removable and reversible access hatches are supported by the frame-shaped member and form a lid for the container. Two table leaves are attached to the frame-shaped member and are each operative to rotate into a respective closed position and into a respective open position. When in their closed positions, the table leaves lie within the space enclosed by the frame-shaped member, causing the assembly to take on a compact shape suitable for transport. When in their open positions, the table leaves provide a stable horizontal table surface suitable for serving food and beverages. Specially designed cutouts and recessed regions in the table leaves further enhance the security of food and beverages during service.

These and other features and advantages of the present invention will become apparent from the following detailed description which is to be read in conjunction with the accompanying drawings.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1A:
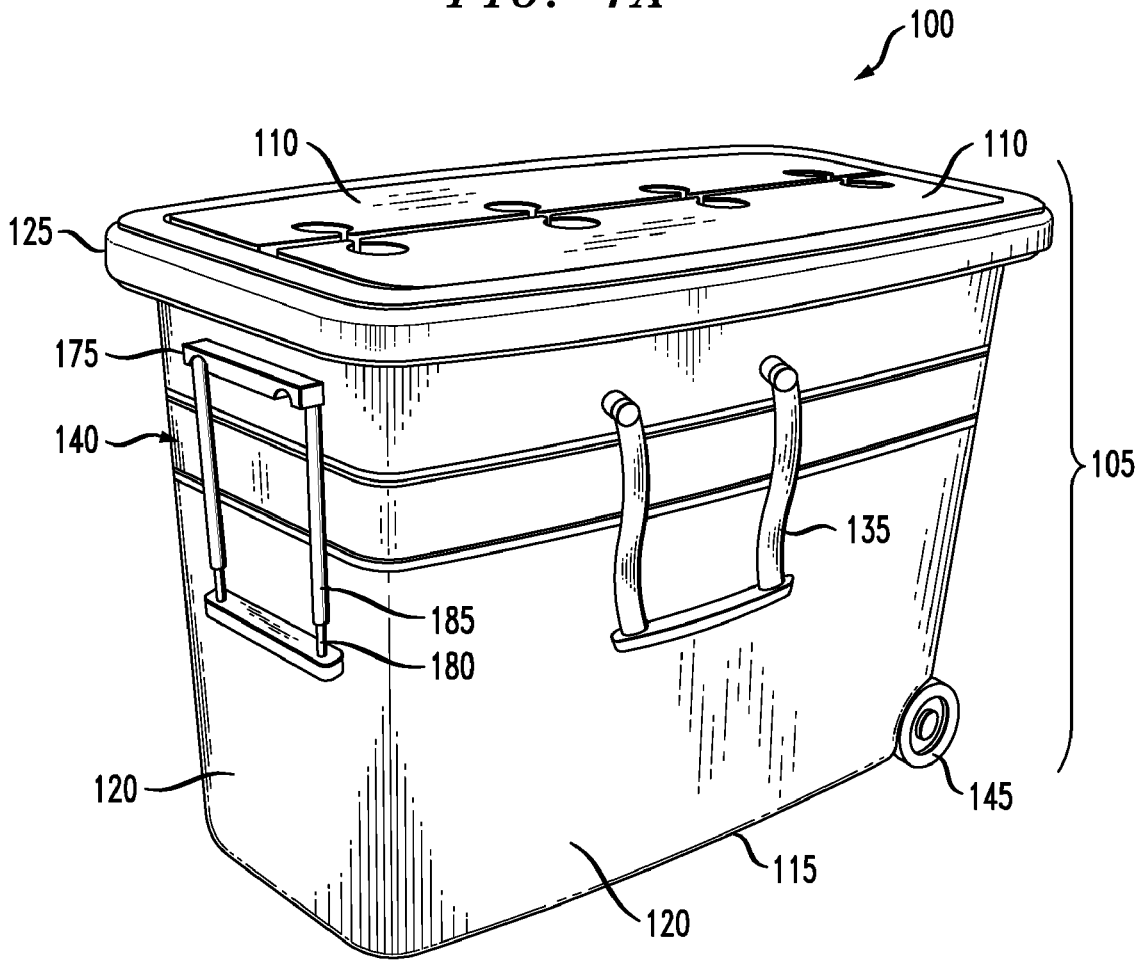
FIG. 1A shows a perspective view of an assembly in accordance with an illustrative embodiment of the invention where the assembly is in its transport configuration.
Figure 1B:
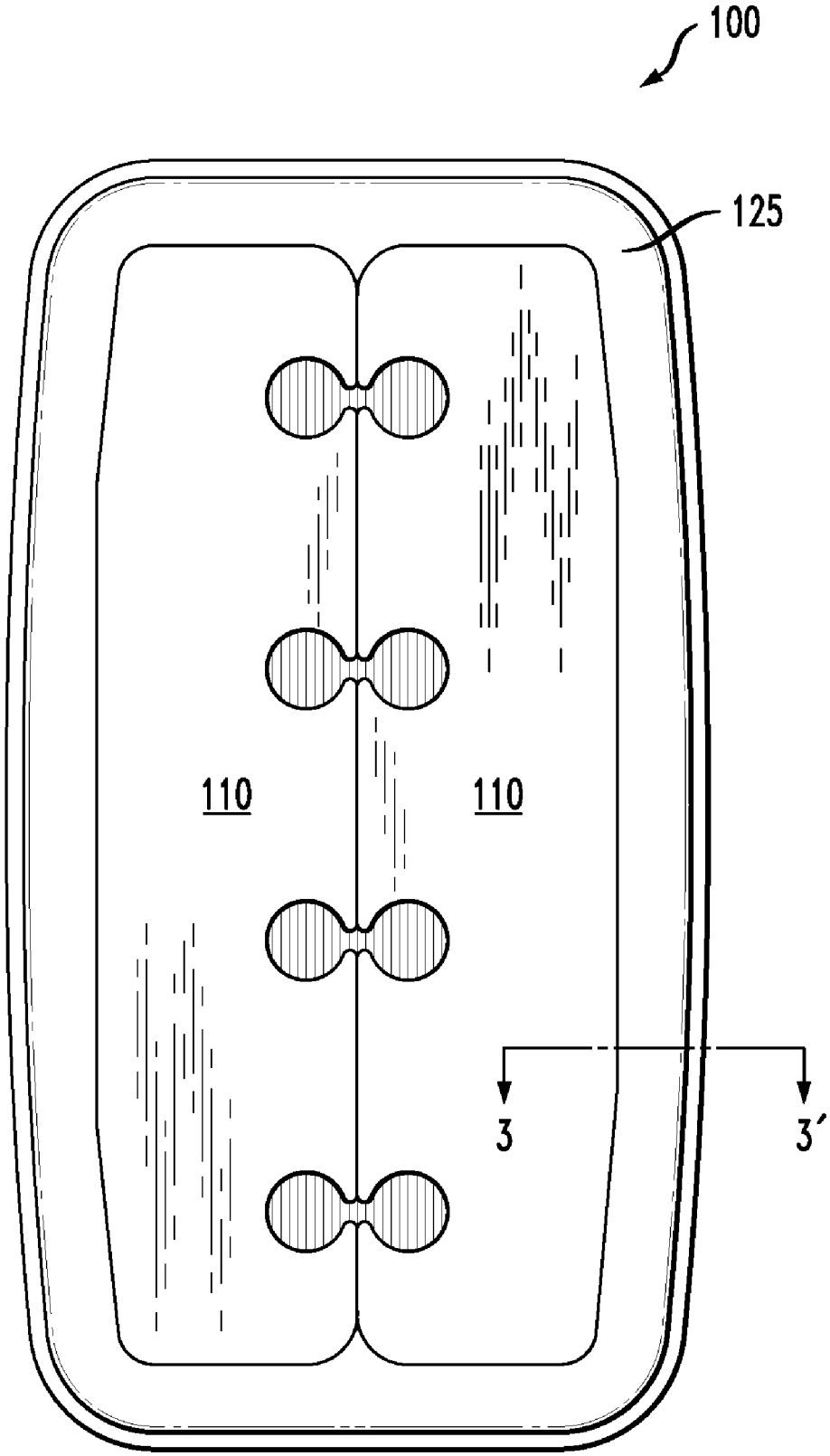
FIG. 1B shows a plan view of the FIG. 1A assembly where the assembly is in its transport configuration.
Figure 2A:
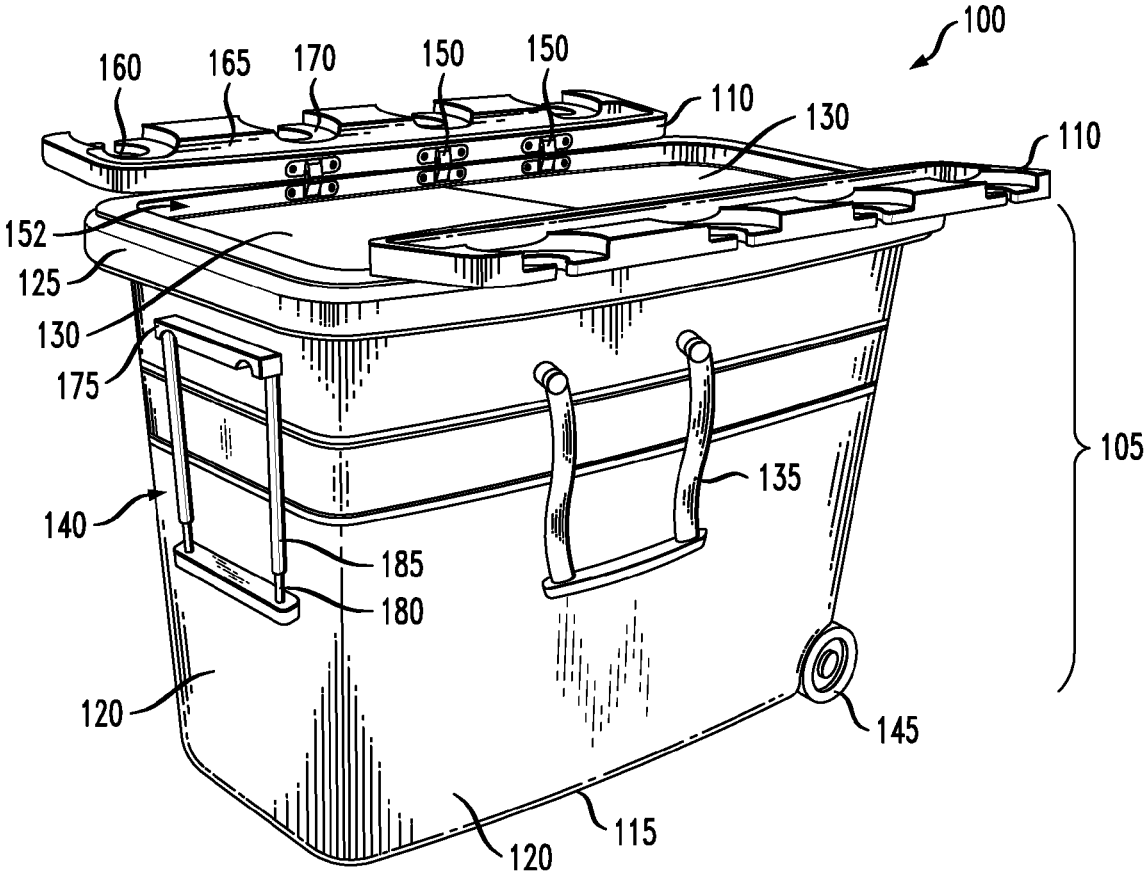
FIG. 2A shows a perspective view of the FIG. 1A assembly where the assembly is in its serving configuration.
Figure 2B:
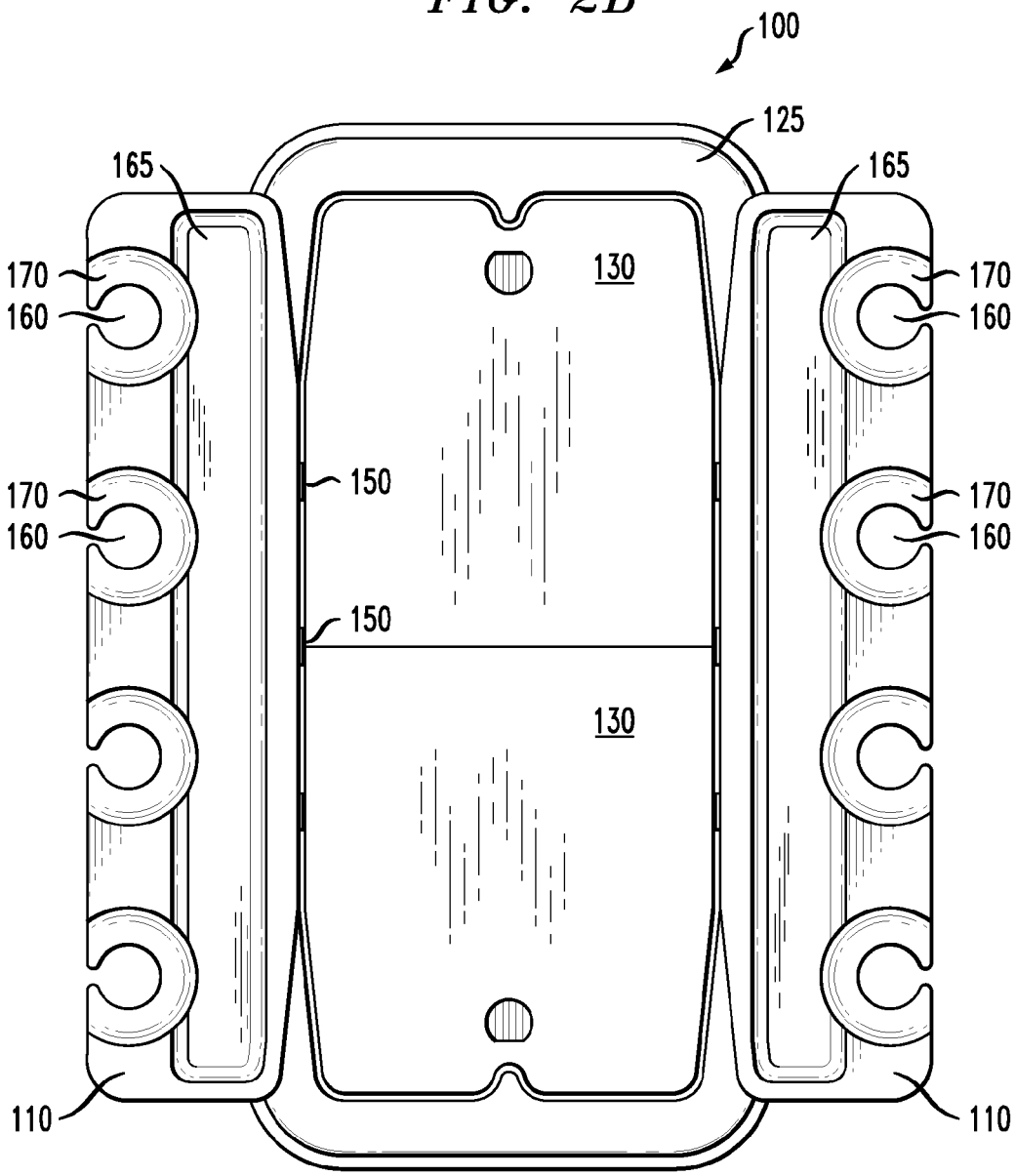
FIG. 2B shows a plan view of the FIG. 1A assembly where the assembly is in its serving configuration.

FIGS. 1A, 1B, 2A, and 2B show a portable container and table assembly 100 in accordance with an illustrative embodiment of the invention. More particularly, FIGS. 1A and 1B show a perspective view and a plan view, respectively, of the assembly in its "transport configuration," while FIGS. 2A and 2B show corresponding views of the assembly in its "serving configuration."

The illustrative assembly 100 comprises a container 105 and two table leaves 110. The container includes a base 115 and four sidewalls 120 that rise upward from the base to a frame-shaped member 125 that forms the upper rim of the container. The frame-shaped member, in turn, supports two removable access hatches 130 that, when in place, act to form a lid for the container. For ease of portability, a pair of strap-style handles 135 (only one visible) and a pivoting, telescoping handle 140 are attached to sidewalls of the container. In addition, a pair of freely-rotating wheels 145 are attached to the container near its base.

The two table leaves 110 are attached to the frame-shaped member 125 of the container 105 via a plurality of hinges 150. The hinges allow each of the table leaves to be rotated into a respective closed position in order to place the illustrative assembly 100 into its transport configuration (FIGS. 1A and 1B) and into a respective open position in order to place the assembly into its serving configuration (FIGS. 2A and 2B). Optionally, one or more of the hinges may be made to lock in a conventional manner so as to secure the table leaves in either position. When in the closed position, each of the table leaves overlies a portion of the container and occupies a space 152 enclosed by the frame-shaped member. Moreover, the uppermost surfaces of the table leaves are substantially coplanar with the uppermost surface of the frame-shaped member. In this configuration, the two table leaves substantially abut one another, thereby making the assembly quite compact for purposes of transport and storage. When in the open position, a portion of each of the table leaves overhangs a region to the side of the container 105 and the table leaves and removable access hatches 130 present horizontal table features well suited to serving food and beverages.

The base 115 and sidewalls 120 are preferably formed as a single piece and may be formed from, for example, lightweight fiberglass using conventional fabrication techniques. The base and sidewalls may be configured to define a storage space with almost any desired shape. In the illustrative assembly 100, the base and sidewalls define a substantially rectangular storage space when considered in a plane parallel to the base. Dimensions in this plane are about 11 inches in width by about 24 inches in length. The height of the sidewalls is about 19 inches. These dimensions are well suited to transporting wine bottles with wine glasses stored on a shelf above the bottles. Nevertheless, this shape and dimensions are merely illustrative and other shapes and dimensions are also contemplated and would still come within the scope of the invention.

The frame-shaped member 125 may be fabricated as part of the base 115 and sidewalls 120, or, alternatively, may be formed separately and securely attached to the top edges of the sidewalls. If formed as a separate piece, it may, for example, be formed of plastic (e.g., polypropylene, polycarbonate, or polystyrene), again using conventional fabrication techniques for the chosen material.

Figure 3:
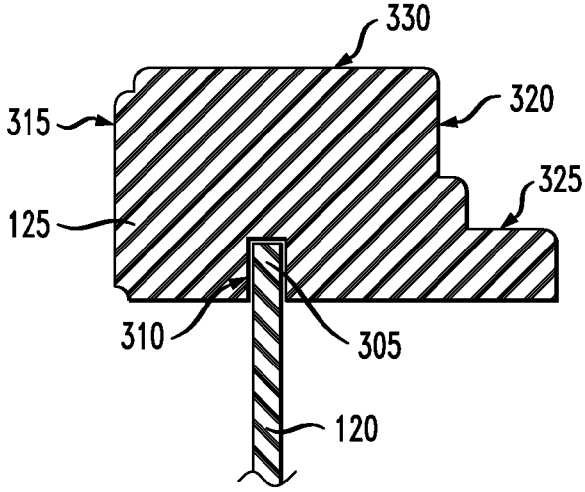
FIG. 3 shows a sectional view of the frame-shaped member.

FIG. 3 shows a sectional view of the frame-shaped member 125 and a portion of an underlying sidewall 120 cut along the plane indicated in FIG. 1B. For illustrative purposes, the frame-shaped member in the assembly 100 is formed as a separate piece from the base 115 and sidewalls and has a vertical thickness of about 1.5 inches. A top portion of the sidewall 305 fits into a groove 310 cut into the bottom of the frame-shaped member, where it is permanently attached using an adhesive or some other suitable fastening means. The various features of the frame-shaped member serve several functions in the assembly. An outer surface 315 serves as a rub-rail, protecting the assembly from nearby objects during transport and storage. An inner surface 320 serves as the mounting surface for the table leaves 110. A lower lip 325 serves to support the access hatches 130. Finally an uppermost surface 330 provides a support surface for the table leaves when the leaves are in their open positions, thereby giving the table leaves solid underlying support when the table leaves are opened.

Figure 4:
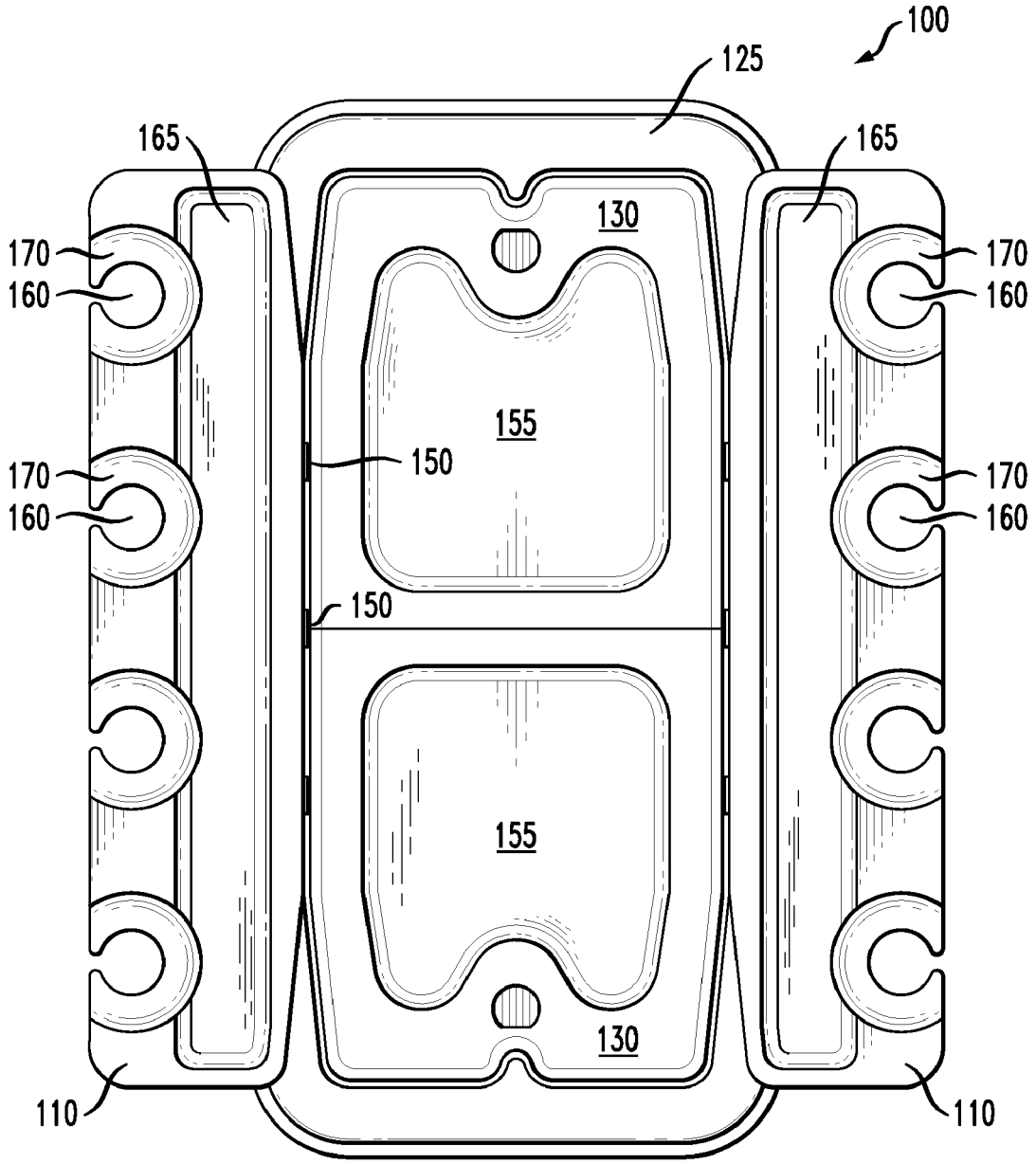
FIG. 4 shows a plan view of the FIG. 1A assembly with the access hatches set such that their recessed regions face upward.
Figure 5:
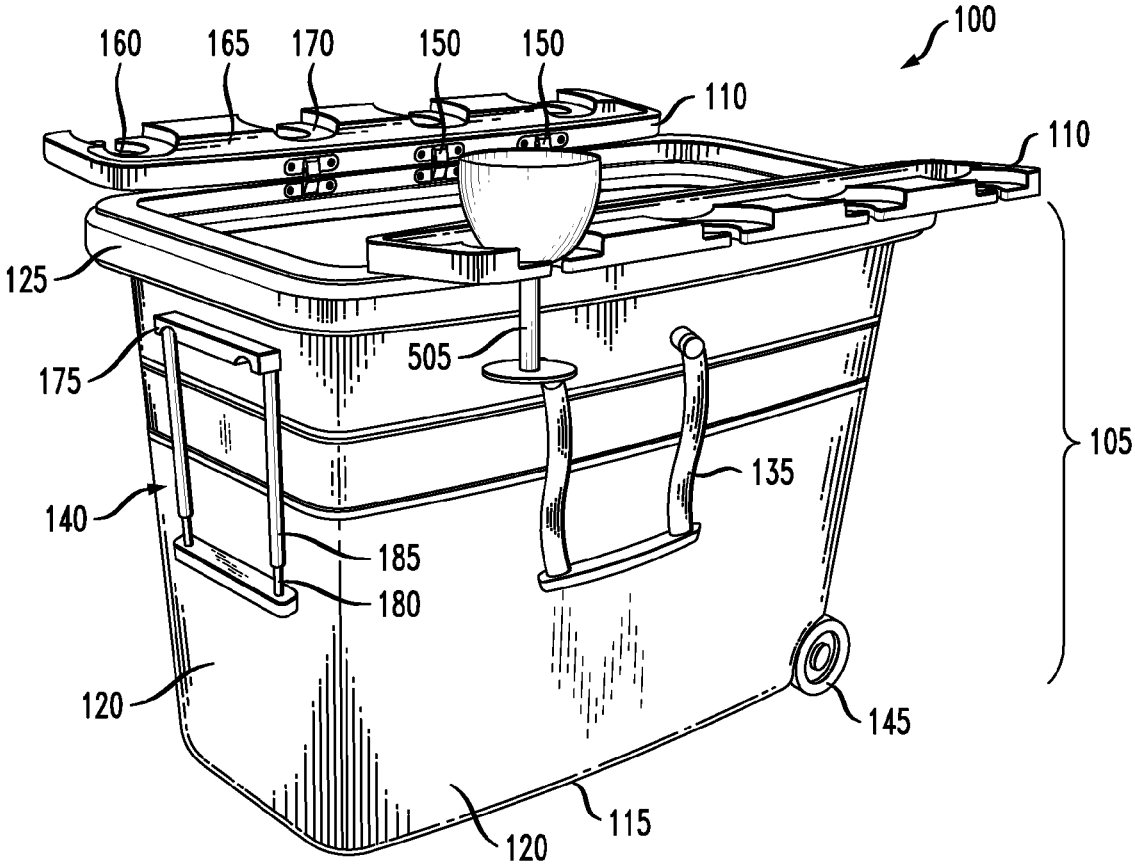
FIG. 5 shows a perspective view of the FIG. 1A assembly with the access hatches removed.

The access hatches 130 themselves may, for example, be made of wood or plastic using conventional fabrication techniques, and are preferably removable so as to provide access to the storage space underneath. Moreover, each of the access hatches preferably comprises two dissimilar sides, one being substantially flat and the other having one or more recessed regions for securely holding food. This allows each of the access hatches to be installed in two different configurations (i.e., they are reversible). In FIGS. 2A and 2B, for example, the access hatches are configured so that their substantially flat sides are pointing upward. With this side up, the access hatches act as a lid for the container 105 and fit neatly below the table leaves 110 when the table leaves are in their closed positions. This configuration is suitable for use during transport. FIG. 4, in contrast, shows a plan view of the assembly 100 with the access hatches configured so that recessed regions 155 face upward. In this configuration, the recessed regions of the access hatches may be used in addition to the table leaves to securely hold various foods during service. Finally, FIG. 5 shows a perspective view of the assembly with the access hatches removed in order to give access to any contents of the container.

Again referring to FIGS. 2A, 2B, and 4, one will note that each of the table leaves 110 in their open position comprises four cutouts 160 as well as a rectangular recessed region 165 and four circular recessed regions 170. In this particular example, each of the cutouts is located within a respective circular recessed region. The circular recessed regions are adapted to securely hold a conventional beverage can or beverage cup in an upright position during service. The cutouts, on the other hand, each include a circular region with a channel along its perimeter that extends to the edge of the table leaf. These cutouts are adapted to securely hold conventional wine glasses (i.e., stemware). As shown in FIG. 5, such a design permits a user to insert the stem of a conventional wine glass 505 into one of these cutouts and lower the glass such that the bell of the wine glass rests on the circular recessed region surrounding that cutout. Such a cutout design is particular well suited for securing these kinds of glasses on uneven terrain or on the pitching deck of a boat. By acting as a "plumb-bob" weight on the stem of the glass, the base of the wine glass may act to align the glass vertically in relation to the Earth in a manner substantially independent of the angle of the assembly 100 itself. At the same time, the wine glass is held securely while remaining easily accessible.

For carrying the assembly 100, the two strap-style handles 135 may be lifted above assembly when the table leaves 110 are in their closed positions and made to come together at their respective centers. Once so configured, the assembly can be conveniently lifted by a user using a single hand. In this way, the strap-style handles function in a manner similar to the handles on a conventional duffle bag. The telescoping handle 140, in turn, is hingedly secured to the container via a support block 175, allowing the handle to be rotated upward 90 degrees for use and folded for storage. As is conventional, each tube of the telescopic handle has an inner tube section 180 that slides within an outer tube section 185, allowing the handle to be extended and retracted. Once rotated upward and extended, the telescopic handle becomes a convenient means by which to roll the assembly on its wheels 145.

Figure 6:
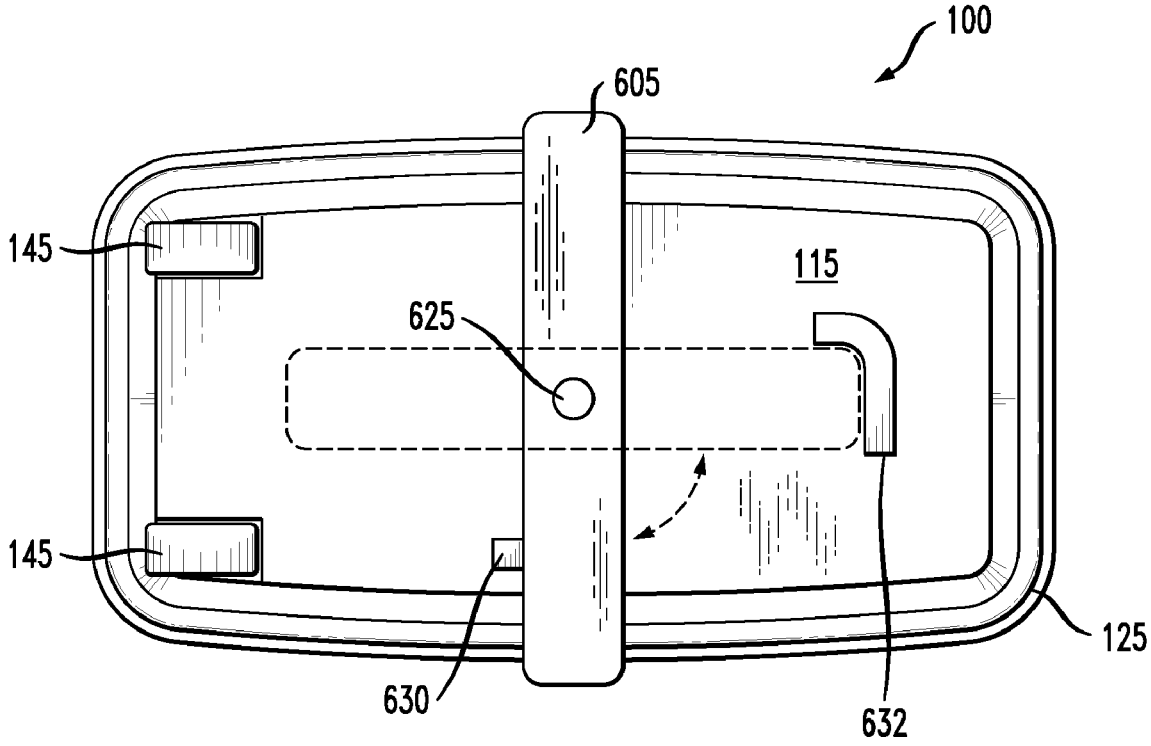
FIG. 6 shows a bottom-up view of the FIG. 1A assembly with the addition of the optional stabilizing bar and its associated hardware.
Figure 7:
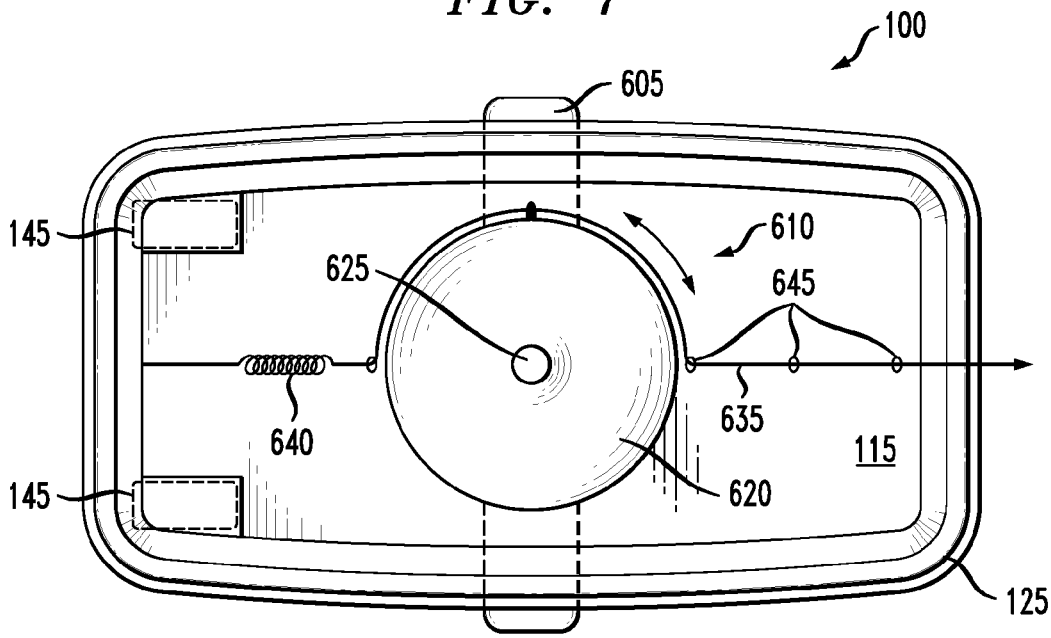
FIG. 7 shows a plan view of the rotation mechanism at the bottom of the assembly.
Figure 8:
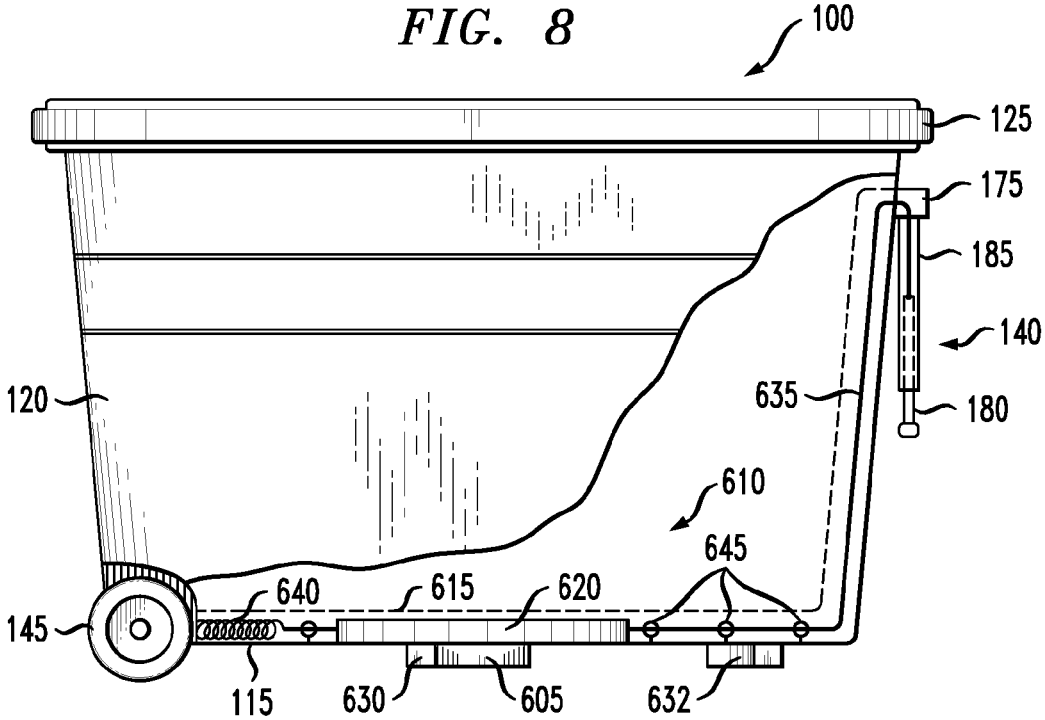
FIG. 8 shows a side view of the FIG. 1A assembly with a portion of the facing sidewall cut away to show the optional stabilizing bar and its associated hardware.

FIGS. 6-8 show the addition of an optional stabilizing bar and its associated rotation mechanism to the assembly 100. More particularly, FIG. 6 shows a bottom-up view of the assembly with the addition of the optional stabilizing bar 605 and its associated rotation mechanism 610. Moreover, FIG. 7 shows a plan view of the rotation mechanism at the bottom of the assembly. Finally, FIG. 8 shows a side view of the assembly with a portion of the facing sidewall 120 cut away so that a side view of the rotation mechanism is visible. A false bottom 615 covers the rotation mechanism and stops any contents stored in the container 105 from interfering with the mechanism's function.

The stabilizing bar 605 is substantially rectangular in a plane parallel to the base 115 of the container 105 and is attached to a rotating disk 620 by a bolt 625 that passes through both features such that the stabilizing bar rotates in unison with the disk. Two stops 630 and 632 attached to the outside of the base 115 restrict the stabilizing bar from rotating by more than 90 degrees as well as act as skid plates for the assembly 100. The rotating disk, in turn, is fixed to a cord 635 with a tensioned spring 640 at one end and one of the inner tube sections 180 of the telescoping handle 140 at the other end. The path of the cord is restricted by the use of several eyelets 645 that are attached to the base of the container 105. When the telescoping handle is extended, the cord is pulled toward the right against the spring as indicated in FIG. 7. This, in turn, extends the spring and rotates both the rotating disk and the stabilizing bar in the clockwise direction (again as referenced against FIG. 7). When the telescoping handle is retracted, the spring pulls the cord to the left, returning the rotating disk and the stabilizing bar to the position indicated in FIGS. 6 and 7.

In this manner, the telescoping handle 140 is able to actuate the rotation mechanism 610 such that the stabilizing bar 605 achieves a first position and a second position. When the telescoping handle is retracted, as might be the case when the assembly 100 is at rest, a portion of the stabilizing bar projects from under the base 115. In this configuration, the stabilizing bar makes the assembly substantially more resistant to tipping when the assembly is used on uneven terrain or the pitching deck of a boat. In contrast, when the telescoping handle is extended, the stabilizing bar rotates such that it entirely underlies the base of the container. In this configuration, the stabilizing is placed out of the way so that they the assembly can more easily be transported. A rotating disk 620 with a radius of 5 inches would, for example, allow the telescoping handle to extend and retract by about 8 inches when moving the stabilizing bar between its first and second positions.

The optional stabilizing bar 605, rotating disk 620, and false bottom 615 may variously comprise, for example, fiberglass or plastic. They may be formed using conventional fabrication techniques for the chosen material or materials.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art. Moreover, all the features disclosed herein may be replaced by alternative features serving the same, equivalent, or similar purpose, unless expressly stated otherwise. Thus, unless expressly stated otherwise, each feature disclosed is one example only of a generic series of equivalent or similar features.

What is claimed is:

1. An assembly comprising:

a container comprising a base, one or more sidewalls extending upward from the base to a frame-shaped member that forms an upper rim, and one or more access hatches supported by the frame-shaped member and forming a lid;

one or more table leaves attached to the frame-shaped member, each of the one or more table leaves operative to rotate into a respective closed position and into a respective open position; and a stabilizing bar, the stabilizing bar attached to an underside of the base of the container, the stabilizing bar operative to rotate into a first position and a second position, wherein at least a portion of the stabilizing bar projects from under the base when in the first position and wherein the entirety of the stabilizing bar underlies the base when in the second position;

wherein each of the one or more table leaves is disposed above at least a portion of the container when in its closed position, and each of the one or more table leaves is at least partially disposed above a region to a side of the container when in its open position.

2. The assembly of claim 1, wherein the one or more access hatches are adapted to be supported in place by one or more lips built into the frame-shaped member.

3. The assembly of claim 1, wherein at least one of the one more access hatches comprises a first side and a second side, the first side being substantially flat and the second side comprising a recessed region.

4. The assembly of claim 1, wherein each of the one or more table leaves when in its closed position is at least partially disposed within a space enclosed by the frame-shaped member.

5. The assembly of claim 1, wherein the portable container comprises two table leaves that substantially abut one another when both table leaves are in their closed positions.

6. The assembly of claim 1, wherein each of the one or more table leaves when in its closed position has a respective uppermost surface that is substantially coplanar with an uppermost surface of the frame-shaped member.

7. The assembly of claim 1, wherein the one or more table leaves is attached to the frame-shaped member by one or more hinges.

8. The assembly of claim 1, wherein each of the one or more table leaves when in its open position rests at least partially on an uppermost surface of the frame-shaped member.

9. The assembly of claim 1, wherein at least one of the one or more table leaves comprises a recessed region.

10. The assembly of claim 1, wherein at least one of the one or more table leaves comprises a cutout that extends to an edge of the respective table leaf.

11. The assembly of 10, wherein the cutout comprises a substantially circular portion.

12. The assembly of claim 10, wherein the cutout lies at least partially within a recessed region.

13. The assembly of claim 1, further comprising one or more wheels attached to the container.

14. The assembly of claim 1, wherein the stabilizing bar is substantially rectangular in a plane parallel to the base of the container.

15. The assembly of claim 1, further comprising a rotation mechanism, the rotation mechanism operative to rotate the stabilizing bar between the first and second positions.

16. The assembly of claim 15, wherein the rotation mechanism comprises a rotating disk.

17. The assembly of claim 16, wherein the rotating disk is coupled to a spring via a cord.

18. The assembly of claim 16, wherein the rotating disk is attached to the stabilizing bar.

19. The assembly of claim 15, further comprising a telescoping handle attached to the container, wherein the rotation mechanism is at least partially actuated by the telescoping handle.

* * * * *